US007230575B2

(12) United States Patent
Jeong

(10) Patent No.: US 7,230,575 B2
(45) Date of Patent: Jun. 12, 2007

(54) DUAL-BAND CHIP ANTENNA MODULE

(75) Inventor: Seong-Heon Jeong, Kunpo-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/181,456

(22) Filed: Jul. 14, 2005

(65) Prior Publication Data

US 2006/0077105 A1 Apr. 13, 2006

(30) Foreign Application Priority Data

Oct. 13, 2004 (KR) ..... 10-2004-0081556

(51) Int. Cl.
*H01Q 1/24* (2006.01)

(52) U.S. Cl. ..... 343/702; 343/700 MS

(58) Field of Classification Search ..... 343/700 MS, 343/702, 846
See application file for complete search history.

(56) References Cited

U.S. PATENT DOCUMENTS 6,266,019 B1 * 7/2001 Stewart et al. ..... 343/702
2004/0075614 A1 4/2004 Dakeya et al.
2005/0057430 A1 * 3/2005 Noguchi et al. ..... 343/895

FOREIGN PATENT DOCUMENTS

| | | |
|---|---|---|
| EP | 0 863 571 | 9/1998 |
| JP | 2000-183634 | 6/2000 |
| WO | WO 03/107482 | 12/2003 |
| WO | WO 2005/022688 | 3/2005 |

* cited by examiner

*Primary Examiner*—Hoang V. Nguyen
(74) *Attorney, Agent, or Firm*—The Farrell Law Firm

(57) ABSTRACT

There is provided a dual-band chip antenna module mounted on a mainboard of a terminal for operating in different frequency bands. In the dual-band chip antenna module, a first antenna element is connected in series with a second antenna element, a feed line is formed on the mainboard to electrically connect the first antenna element with an RF connector, and a radiation pattern is extended from the second antenna element. Therefore, the gain of the dual-band chip antenna module configured in series is increased to over twice that of a dual-band chip antenna module configured in parallel.

10 Claims, 5 Drawing Sheets

PARALLEL CHIP ANTENNA MODULE

SERIES CHIP ANTENNA MODULE

DUAL-BAND CHIP ANTENNA MODULE

PRIORITY

This application claims priority under 35 U.S.C. § 119 to an application entitled "Dual-Band Chip Antenna Module" filed in the Korean Intellectual Property Office on Oct. 13, 2004 and assigned Serial No. 2004-0081556, the contents of which are incorporated herein by reference.

BACKGROUND OF THE INVENTION

1. Field of the Invention

The present invention relates to a surface mountable chip antenna module for a portable wireless terminal, and more particularly, to a dual-band chip antenna module having elements connected in series to allow a high-band antenna element to utilize a low-band antenna element, such that the antenna module can have an increased current distribution and gain and thereby have an improved radiation performance.

2. Background of the Prior Art

Recently, mobile wireless terminals, such as the Personal Digital Assistant (PDA), the Personal Communication Service (PCS) terminal, the Distributed Communication System (DCS) terminal, Global Positioning System (GPS) terminal, cellular phones and wireless notebook computers, are becoming more popular, and terminals with various functions and designs are being introduced. Further, small-sized, slim, and lightweight terminals are also being introduced, and at the same time the terminals are required to have various functions to satisfy user's demand. Therefore, the designs of the terminals are focused on size reduction while maintaining or improving the functions to satisfy the user's demand.

Specifically, a rod antenna (or whip antenna) and a helical antenna, which protrude outward from the terminal, are easy to break, and deteriorate the external appearance and portability of the terminal. Therefore, an antenna installed within the terminal is becoming more popular (and referred to as a built-in antenna, internal antenna, or intenna), and efforts are ongoing to improve the performance and productivity of the built-in antenna. There are two types of built-in antennas in common use: a planar inverted F antenna (PIFA) module having a feeding point and a ground point, and a chip antenna module suitable for mounting on a ceramic dielectric substance and having a copper coil the turns of which are adjusted according to the operating frequency of the terminal.

Since the chip antenna module is mounted on an RF mainboard of a terminal in the form of surface mounted device (SMD), it takes less space than the PIFA type antenna and thereby enables the terminal to have a slim, simple, and lightweight appearance.

The chip antenna module is commonly used for a dual-band terminal. That is, the dual-band terminal has two antenna elements mounted on its mainboard, for example, a low-band antenna element for a 900-MHz CDMA or GSM application and a high-band antenna element for an 1800-MHz PCS or DCS application.

The arrangement of the low-band and high-band antenna elements of the chip antenna module is disclosed in co-pending U.S. patent application Ser. No. 10/969,589, filed on Oct. 20, 2004, and assigned to the present assignee, in which an RF connector of a mainboard and two antenna elements of different frequency bands are connected in parallel, and a radiation plate is employed to improve a radiation characteristic of the antenna.

SUMMARY OF THE INVENTION

In the parallel configuration of the chip antenna module described above, the two antenna elements of different frequency bands are not associated with each other and therefore operate separately. Also, the mainboard where the antennas are to be mounted must be compartmented because each antenna element requires a separate radiation plate.

In order to solve at least the above mentioned problems, the present invention provides a dual-band chip antenna module, of which a first antenna element has an increased current distribution than that of a second antenna element of a different frequency band, such that the antenna module can improve its radiation characteristics.

Also, the present invention provides a dual-band chip antenna module, of which at least two antenna elements are mounted in series on a mainboard. This series-mounting configuration allows a first antenna element of a higher frequency band to utilize a second antenna element of a lower frequency band, such that the first antenna element can increase its current distribution. This increase in current distribution improves the radiation characteristic of the antenna module.

Further, the present invention provides a dual-band chip antenna module, of which at least two antenna elements are mounted in series on a mainboard, and cooperate therebetween in operation. This series-mounting configuration requires only one radiation plate such that a mounting space for the antenna module can be reduced, thereby reducing the overall size of the wireless terminal where the antenna module is to be mounted.

Further, the present invention provides a dual-band chip antenna module, of which at least two antenna elements are mounted in series on a mainboard in order to obtain an improved antenna module characteristic, such that a wireless terminal in which the antenna module is to be installed can have an increased reliability.

According to an aspect of the present invention, a dual-band chip antenna module mounted on a mainboard of a terminal for operating in different frequency bands, includes a first antenna element and a second antenna element that are connected in series; a feed line formed on the mainboard to electrically connect the first antenna element with an RF connector; and a radiation plate extended from the second antenna element.

In the dual-band chip antenna module, a first antenna element of a relatively low frequency band may be connected to the RF connector by the feed line, such that a second antenna element of a relatively high frequency band can utilize the first antenna element to increase its current distribution. Therefore, the dual-band chip antenna module having the connection configuration allows the second antenna element to have an increased current distribution when compared with the related art dual-band chip antenna module having antenna elements configured in parallel. Consequently, the dual-band chip antenna can have an increased gain and radiation performance.

Further, the feed line may be used as a radiation plate (a radiation pattern) besides its use for connecting the antenna element to the RF connector, such that an additional radiation plate is not required and thereby the wireless terminal can have slim, simple, lightweight features.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Also, when it is determined that the subject of the invention may be obscured by a detailed description, the detailed description will be omitted.

A folder type terminal is illustrated to describe the present invention, but the present invention can be applied to any types of terminals. The present invention is not limited to the illustrated terminal. The present invention can be applied to various kinds of terminals such as a dual-band terminal using a chip antenna module.

Figure 1:
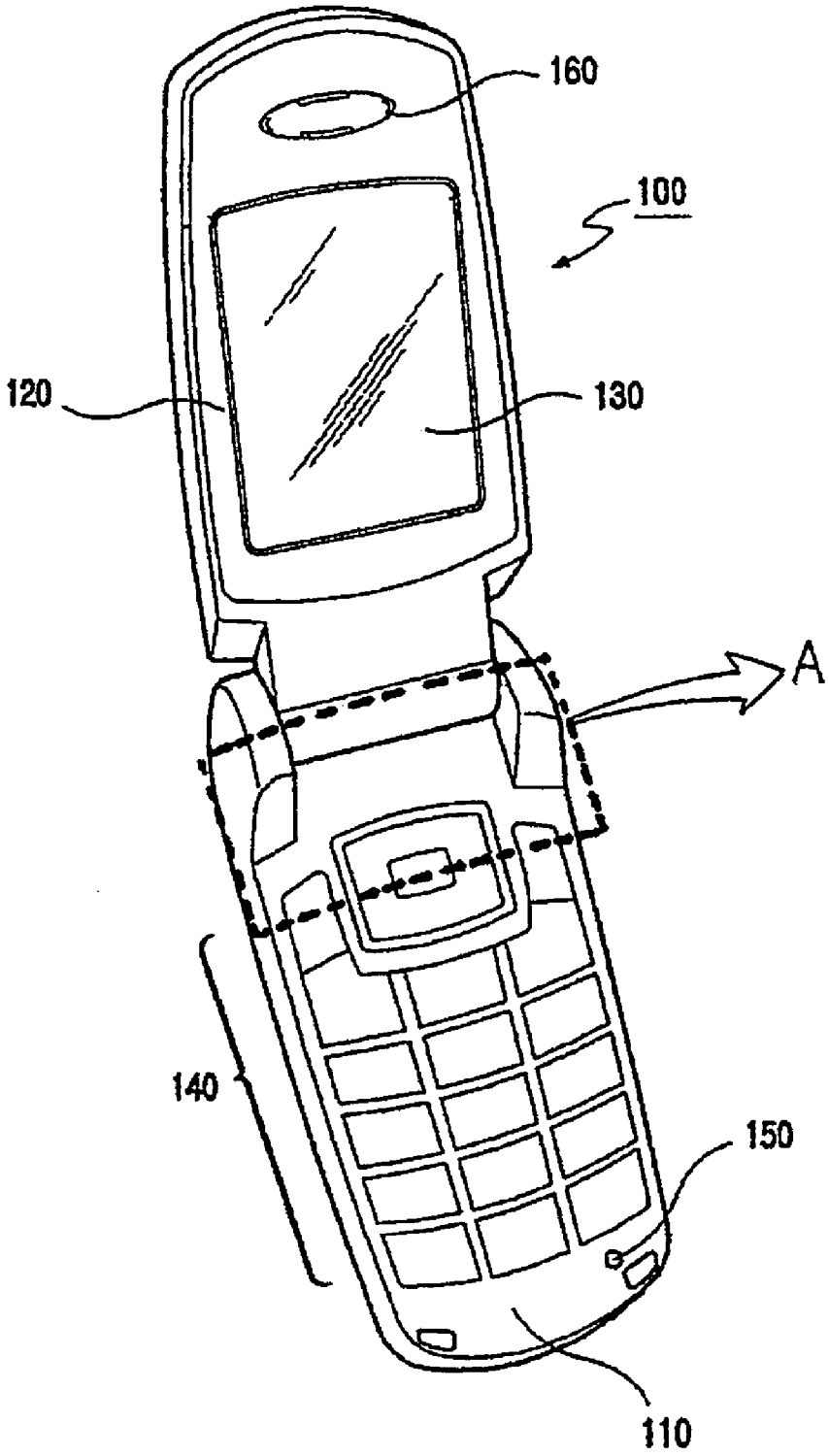
FIG. 1 is a perspective view of a portable wireless terminal in which a chip antenna module is installed according to the present invention.

FIG. 1 is a perspective view of a portable wireless terminal in which a chip antenna module is installed according to the present invention.

Referring to FIG. 1, a terminal 100 with a built-in antenna includes a main body 110, a folder 120 rotatably coupled to the main body 110, and a hinge module (not shown) enabling the rotation of the folder 120 at a predetermined angle range (generally between 130–140°)

The main body 110 includes a keypad assembly 140 having navigation key buttons as a data input device and a microphone 150 below the keypad assembly 140 to receive a user's voice. The folder 120 includes a display 130 as an output device and an speaker 160 through which the user can hear sounds. Also, the terminal 100 may include an external display such as a slave LCD module on an outer surface of the folder and a camera above the external display for taking pictures (not shown in the drawings). Since the terminal 100 uses a built-in antenna module installed therein, a protruded antenna is not present. The built-in antenna module may be installed in a dashed-line portion "A".

Figure 2:
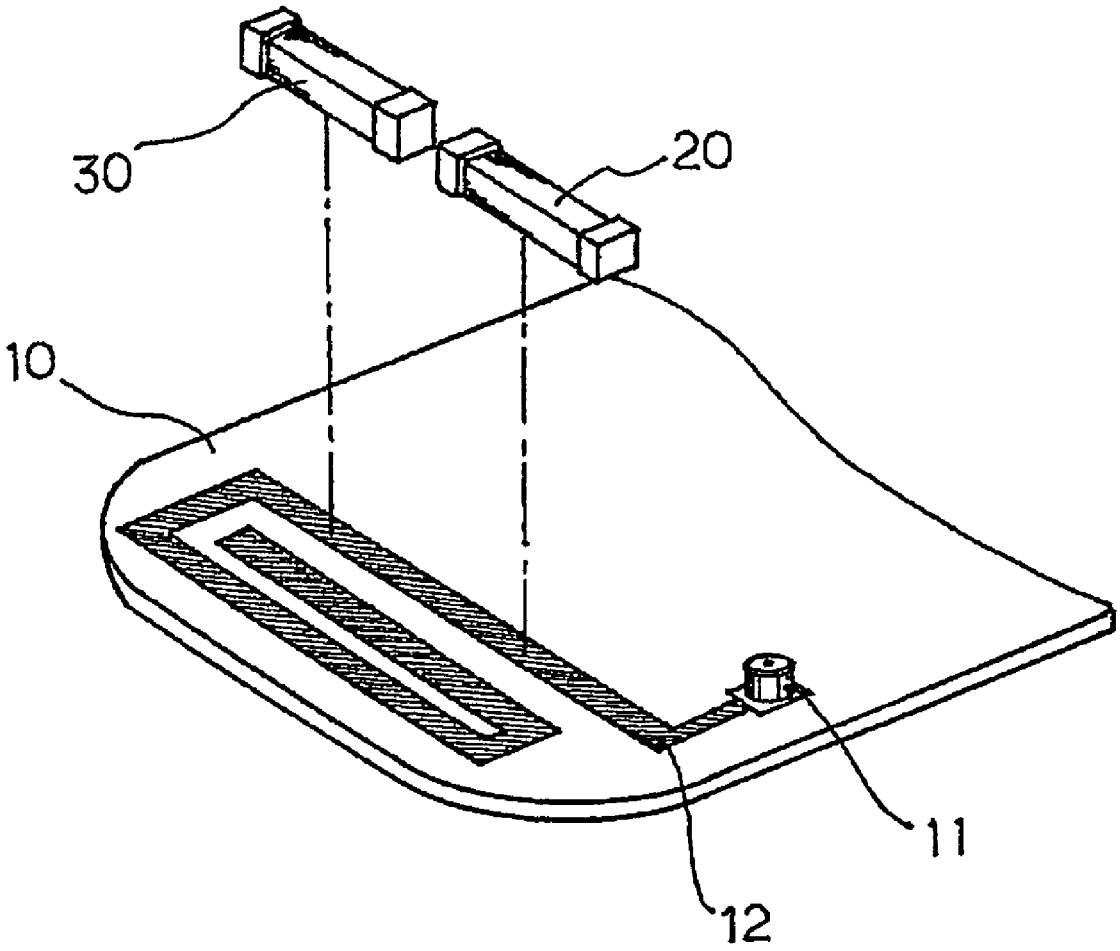
FIG. 2 is a partial exploded perspective view of a chip antenna module to be mounted on a mainboard according to the present invention.
Figure 3:
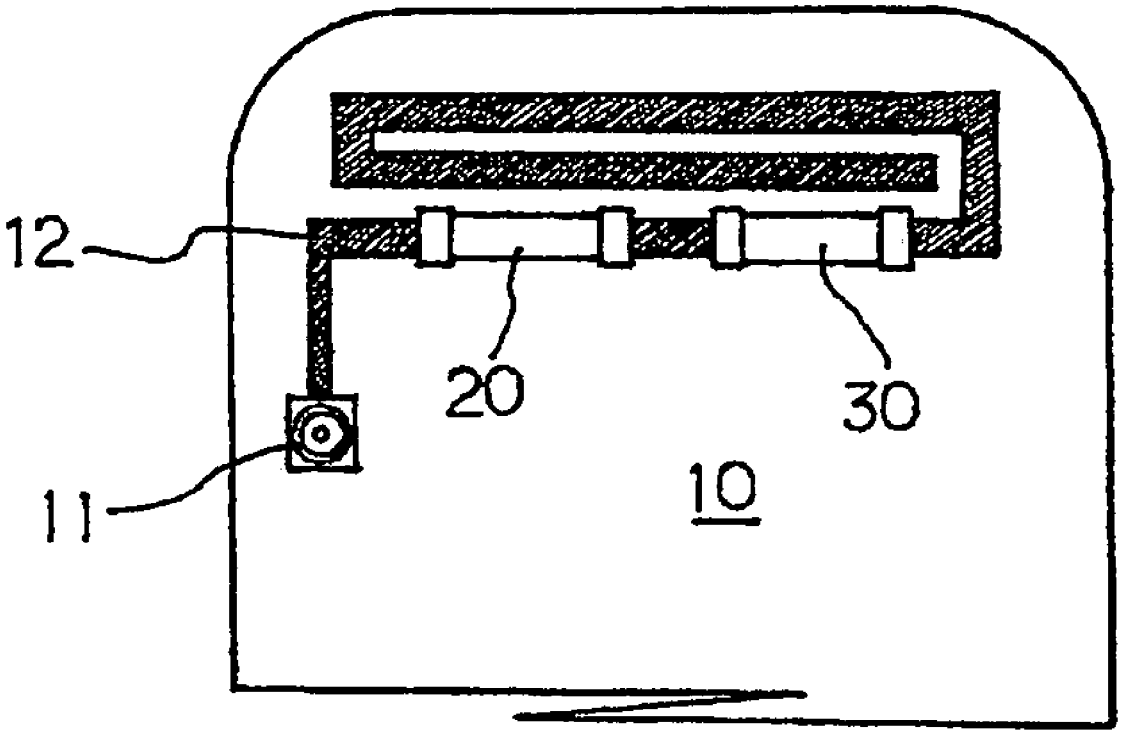
FIG. 3 is a partial plain view showing a chip antenna module mounted on a mainboard according to the present invention.

FIG. 2 is a partial exploded perspective view of a chip antenna module to be mounted on a mainboard according to the present invention, and FIG. 3 is a partial plain view showing a chip antenna module mounted on a mainboard according to the present invention.

There are two antenna elements, a first antenna element 20 and a second antenna element 30. The second antenna element 30 is used for a high frequency band, for example, 1800-MHz PCS or DCS terminals, and the first antenna element 20 is used for a low frequency band, for example, 900-MHz CDMA or GSM terminals.

An RF mainboard 10 of the terminal 100 includes an RF connector 11 at a selected portion and a feed line 12 electrically connected to the RF connector 11. The feed line 12 may be a conductive pattern integrally fabricated on the mainboard 10. However, the feed line 12 is not limited to the conductive pattern. The feed line 12 may be a thin conductive plate fixed on the mainboard 10 or a flexible printed circuit (FPC) of which an upper dielectric coating is removed. Bonding with a conductive foam or soldering may be used to affix the conductive plate and the FPC to the RF mainboard 10. Also, the shape of the feed line 12 may be changed according to the size, shape, and operating frequency of the terminal 100. That is, the feed line 12 is provided to connect the RF connector 11 of the mainboard 10 with the two antenna elements 20 and 30, and to function as a conductive pattern for improving the radiation of the chip antennas.

The first and second antenna elements 20 and 30 are mounted on the feed line 12 in series by using solder, conductive foam, or conductive adhesive. Herein, the first antenna element 20 for a relatively low frequency band is placed between the RF connector 11 and the second antenna element 30 for a relatively high frequency band, such that the second antenna element 30 can utilize the current distribution of the first antenna element 20. This arrangement allows the high-band antenna element 30 to have an increased current distribution and gain, thereby improving the radiation performance of the antenna module.

Figure 4A:
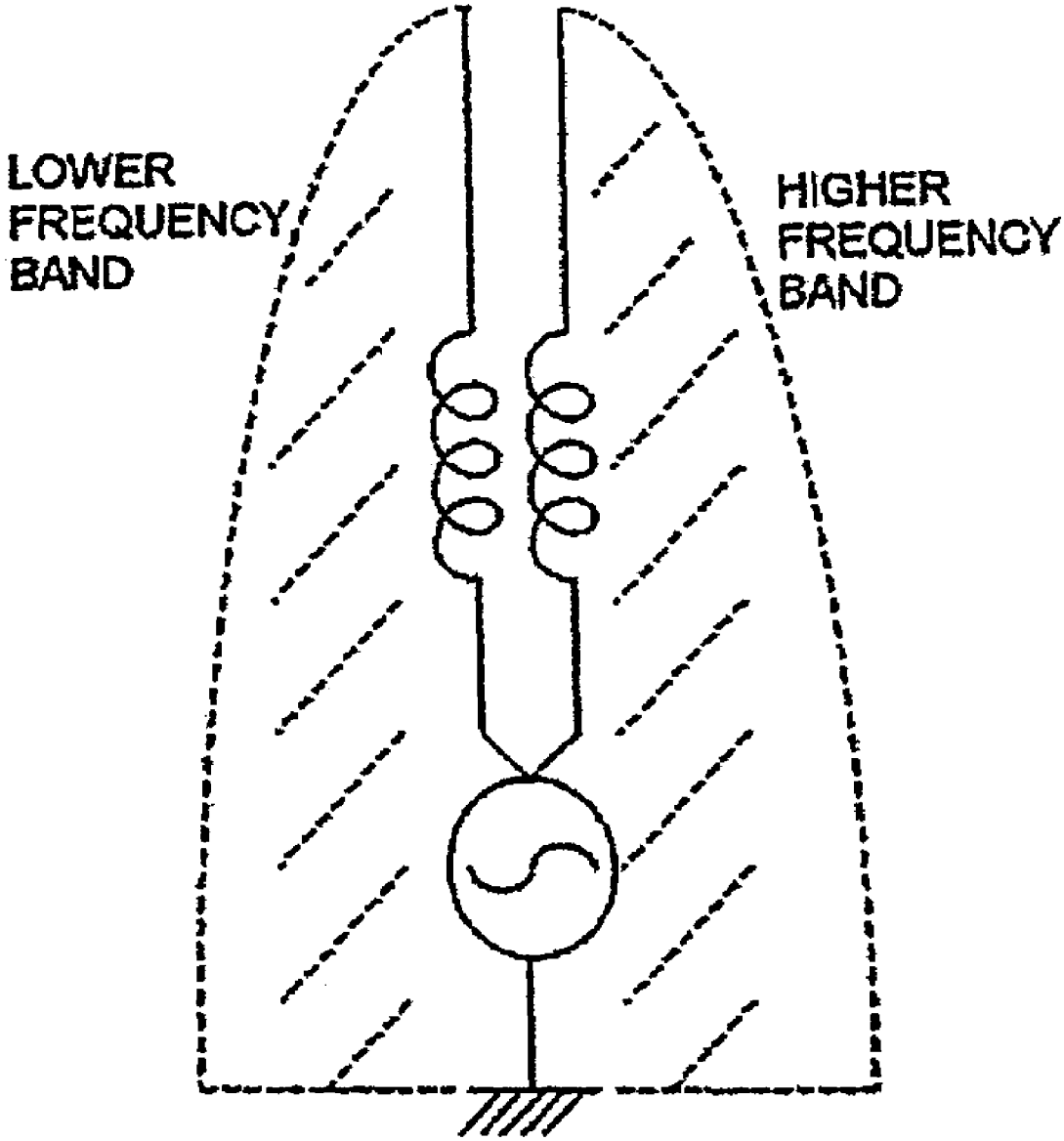
FIGS. 4A and 4B are equivalent circuit diagrams showing a parallel chip antenna module of the related art and a series chip antenna module of the present invention.
Figure 4B:
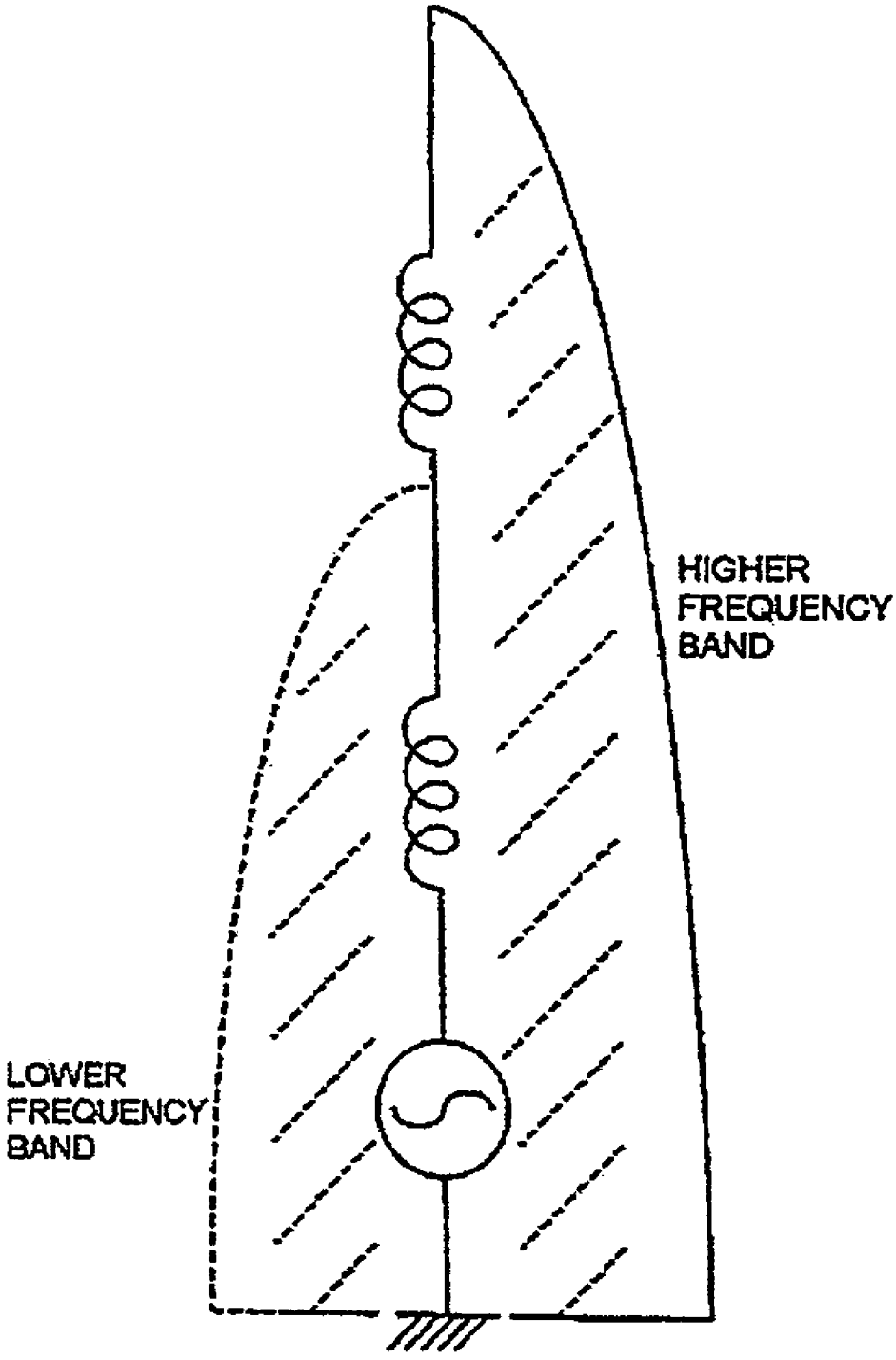

FIG. 4A is an equivalent circuit diagram showing a current distribution when two antenna elements are connected in parallel to a feed line according to the related art, and FIG. 4B is an equivalent circuit diagram showing a current distribution when two antenna elements are connected in series to a feed line according to the present invention.

Referring to FIG. 4A, in the parallel chip antenna module configuration of the related art, the low-band antenna element has the same current distribution as the high-band antenna element. Referring to FIG. 4B, however, in the series chip antenna module configuration of the present invention, the current distribution of the high-band antenna element 30 is more than two times wider than that of the low-band antenna element 20 because the high-band current distribution includes the low-band current distribution. That is, the current distribution of the high-band antenna element 30 according to the present invention is increased by more then twice that of the related art high-band antenna element, thereby increasing the gain of the high-band antenna element 30.

As described above, the series configuration of the chip antenna module enables the increase in antenna gain when compared with the related art parallel configuration, thereby improving antenna performance.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A dual-band chip antenna module mounted on a mainboard of a terminal for operating in different frequency bands, comprising:

a continuous feed line having proximal and distal ends, said feed line formed on the mainboard;

an RF connector attached to the proximal end of the feed line;

first and second antenna elements located between the proximal and distal ends of the feed line and mounted upon the continuous feed line such that the first and second antenna elements are connected in series; and a radiation pattern extending beyond the second antenna element and formed on the mainboard.

2. The dual-band chip antenna module of claim 1, wherein the feed line and the radiation pattern are integrally formed.

3. The dual-band chip antenna module of claim 1, wherein the first and second antenna elements operate in different frequency bands.

4. The dual-band chip antenna module of claim 3, wherein the first antenna element operates in a lower frequency band than the frequency band of the second antenna element, such that a current distribution of the second antenna element includes a current distribution of the first antenna element.

5. The dual-band chip antenna module of claim 1, wherein the feed line and the radiation pattern are metal pads or FPCs (flexible printed circuits) fixed on the mainboard.

6. The dual-band chip antenna module of claim 2, wherein the feed line and the radiation pattern are metal pads or FPCs (flexible printed circuits) fixed on the mainboard.

7. The dual-band chip antenna module of claim 1, wherein the feed line and the radiation pattern are conductive patterns having a predetermined shape, formed when the mainboard is fabricated.

8. The dual-band chip antenna module of claim 2, wherein the feed line and the radiation pattern are conductive patterns having a predetermined shape, formed when the mainboard is fabricated.

9. The dual-band chip antenna module of claim 1, wherein the first and second antenna elements are mounted on the mainboard by a soldering.

10. The dual-band chip antenna module of claim 1, wherein the first and second antenna elements are bonded on the mainboard by using a conductive foam.

* * * * *